US009478910B2

(12) United States Patent
Nonen et al.

(10) Patent No.: US 9,478,910 B2
(45) Date of Patent: Oct. 25, 2016

(54) CONNECTOR AND CONNECTORIZED CABLE

(71) Applicant: Hitachi Metals, Ltd., Tokyo (JP)

(72) Inventors: Hideki Nonen, Mito (JP); Yoshiaki Ishigami, Hitachi (JP)

(73) Assignee: Hitachi Metals, Ltd., Tokyo (JP)

( * ) Notice: Subject to any disclaimer, the term of this patent is extended or adjusted under 35 U.S.C. 154(b) by 0 days.

(21) Appl. No.: 15/003,999

(22) Filed: Jan. 22, 2016

(65) Prior Publication Data

US 2016/0233613 A1 Aug. 11, 2016

(30) Foreign Application Priority Data

Feb. 6, 2015 (JP) ..... 2015-022277

(51) Int. Cl.
*H01R 13/627* (2006.01)
*H01R 13/633* (2006.01)

(52) U.S. Cl.
CPC ..... *H01R 13/6335* (2013.01)

(58) Field of Classification Search
CPC ..... G02B 6/4246; H01R 13/508; H01R 13/6583; H01R 9/032; H01R 9/0515
See application file for complete search history.

(56) References Cited

U.S. PATENT DOCUMENTS 7,226,316 B2 * 6/2007 Wu ..... H01R 13/5804 439/357
7,354,292 B1 * 4/2008 Lloyd ..... H01R 13/6272 439/352
7,402,070 B1 * 7/2008 Wu ..... H01R 13/635 439/152
7,841,887 B2 * 11/2010 Zhang ..... G02B 6/4246 439/352
8,064,207 B2 * 11/2011 Wu ..... G06K 13/08 361/726
8,388,366 B2 3/2013 Yang
8,668,515 B2 * 3/2014 Wu ..... H01R 13/633 439/352
8,747,141 B2 * 6/2014 Crain ..... H01R 13/6272 439/258
2009/0227133 A1 * 9/2009 Zhang ..... G02B 6/4246 439/160
2011/0267742 A1 * 11/2011 Togami ..... G02B 6/4246 361/679.01
2012/0064779 A1 * 3/2012 Wu ..... H01R 9/032 439/676

* cited by examiner

*Primary Examiner* — Briggitte R Hammond
(74) *Attorney, Agent, or Firm* — Roberts Mlotkowski Safran Cole & Calderon, PC

(57) ABSTRACT

A connector includes a connector housing, a sliding member supported on the connector housing, and a pull member coupled to the sliding member. A protrusion is formed on the pull member so as to protrude in a thickness direction thereof and extend in a lateral direction orthogonal to a longitudinal direction along the direction of removal. The sliding member includes a pair of arm portions guided by the connector housing and a coupling portion coupling the pair of arm portions and facing a side surface of the protrusion that is a surface on the operating portion side. The side surface of the protrusion butts against the coupling portion when the operating portion of the pull member is pulled in the direction of removal such that a moving force in the direction of removal is applied to the coupling portion from the protrusion so as to move the sliding member.

6 Claims, 9 Drawing Sheets

CONNECTOR AND CONNECTORIZED CABLE

The present application is based on Japanese patent application No.2015-022277 filed on Feb. 6, 2015, the entire contents of which are incorporated herein by reference.

BACKGROUND OF THE INVENTION

1. Field of the Invention

The invention relates to a connector prevented from slipping off by a locking piece provided on a mating member, and a connectorized cable provided with the connector.

2. Description of the Related Art

A connector is known which is fitted to e.g. a shielding cage having a shielding function and can be prevented from slipping off by a locking piece(s) provided on the shielding cage. The connector is provided with a member for disengaging the locking piece to cancel the slip-off prevention (see e.g. U.S. Pat. No. 8,388,366).

The connector disclosed in U.S. Pat. No. 8,388,366 is provided with a sliding member slidable along a longitudinal direction of a rectangular parallelepiped-shaped connector housing, and is configured that slide movement of the sliding member disengages the locking piece to cancel the slip-off prevention. A pull member (pull unit) is coupled to the sliding member, and a worker holds and pulls the pull member in a removal direction of the connector to pull out the connector from the shielding cage. The sliding member is thereby moved and disengages the locking piece to cancel the slip-off prevention.

If the sliding member is moved to a movable end by further pulling the pull member, a force of pulling the pull member acts on the connector housing so as to remove the connector from the shielding cage.

SUMMARY OF THE INVENTION

The pull member disclosed in U.S. Pat. No. 8,388,366 is coupled to the sliding member by a pair of pins (locating-pins) and/or a pair of hooks. However, the pull member when repeatedly pulled may crack or may be even broken due to load applied to the pins or hooks. In addition, if a burr, etc., is formed around a hole on the sliding member into which the pin or hook is inserted, cracks or breakage are more likely to occur. Therefore, there is a demand for a highly durable connector in which a portion of a pull member coupled to a sliding member does not crack or is not broken even when the connector is repeatedly inserted and pulled out.

It is an object of the invention to provide a connector that has such improved durability that the pull member does not crack or is not broken even when the connector is repeatedly inserted and pulled out, as well as a connectorized cable equipped with the connector.

(1) According to an embodiment of the invention, a connector for being fitted to an other member so as to be prevented from slipping off by a locking piece provided on the other member comprises:

a connector housing comprising a recessed portion to be engaged with the locking piece;

a metal sliding member that is supported on the connector housing so as to be slidable along a direction of attaching/detaching to/from the other member and disengages the locking piece from the recessed portion by moving in a direction of removal from the other member; and a long plate-shaped resin pull member that is coupled to the sliding member and comprises an operating portion to be operated when moving the sliding member in the direction of removal;

wherein a protrusion is formed on the pull member so as to protrude in a thickness direction thereof and to extend in a lateral direction orthogonal to a longitudinal direction along the direction of removal, wherein the sliding member comprises a pair of arm portions guided by the connector housing and a coupling portion coupling the pair of arm portions and facing a side surface of the protrusion of the pull member that is a surface on the operating portion side, and wherein the side surface of the protrusion butts against the coupling portion when the operating portion of the pull member is pulled in the direction of removal such that a moving force in the direction of removal is applied to the coupling portion from the protrusion so as to move the sliding member.

(2) According to another embodiment of the invention, a connectorized cable comprises:

the connector according to the above embodiment (1); and a cable portion having one end housed in the connector and comprising linear signal transmission media.

Effects of the Invention

According to an embodiment of the invention, a connector can be provided that has such improved durability that the pull member does not crack or is not broken even when the connector is repeatedly inserted and pulled out, as well as a connectorized cable equipped with the connector.

BRIEF DESCRIPTION OF THE DRAWINGS

Next, the present invention will be explained in more detail in conjunction with appended drawings, wherein:

FIGS. 7A and 7B are perspective views showing a disengaging portion of the sliding member in a recessed portion of a connector housing, wherein FIG. 7A shows a situation where the sliding member is located on the connector housing at a movable limit in a direction opposite to the removal direction and FIG. 7B shows a situation where the sliding member is located on the connector housing at a movable limit in the removal direction;

DETAILED DESCRIPTION OF THE PREFERRED EMBODIMENTS

Embodiment

Figure 1:
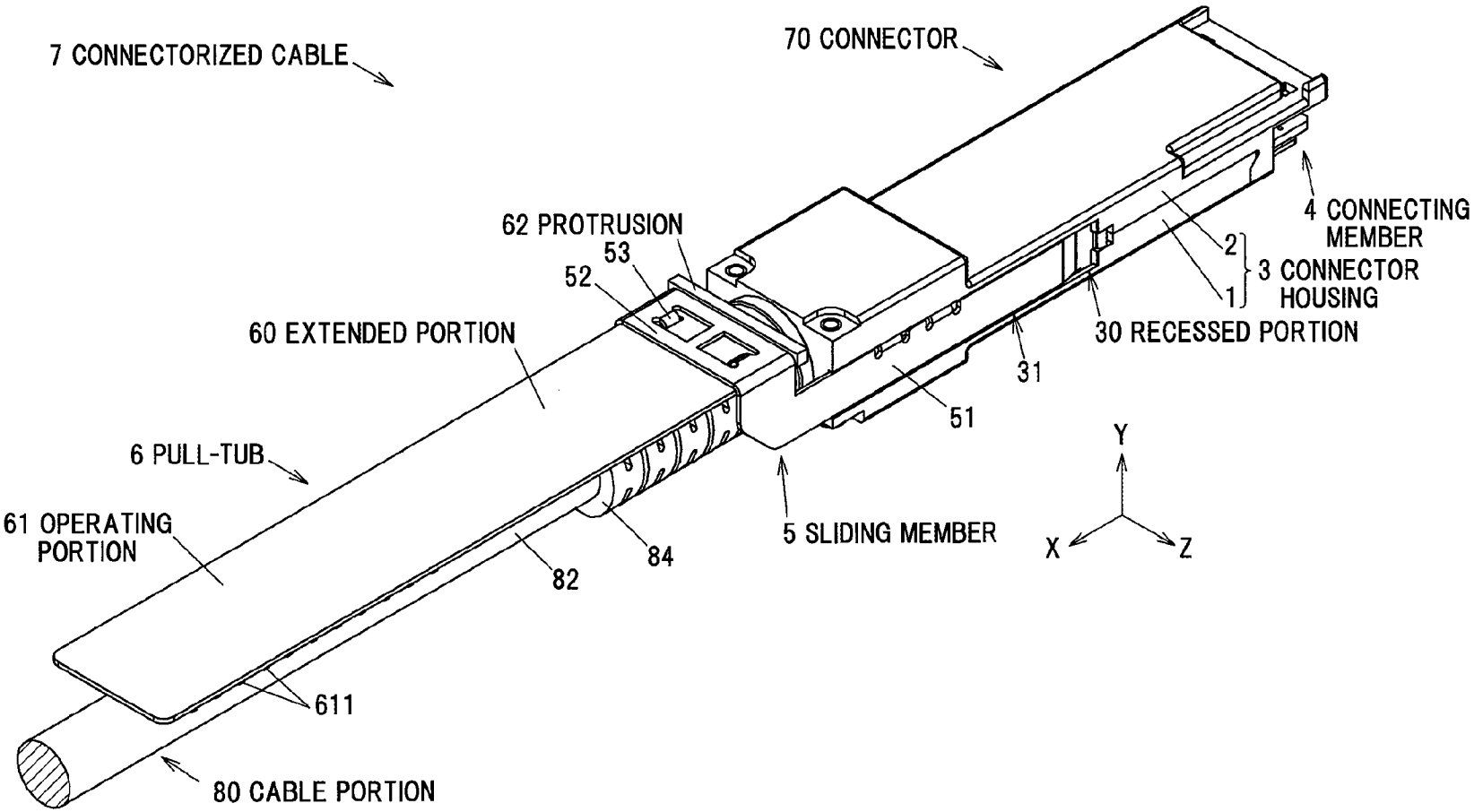
FIG. 1 is a perspective view showing a connectorized cable and a connector in an embodiment of the present invention.
Figure 2:
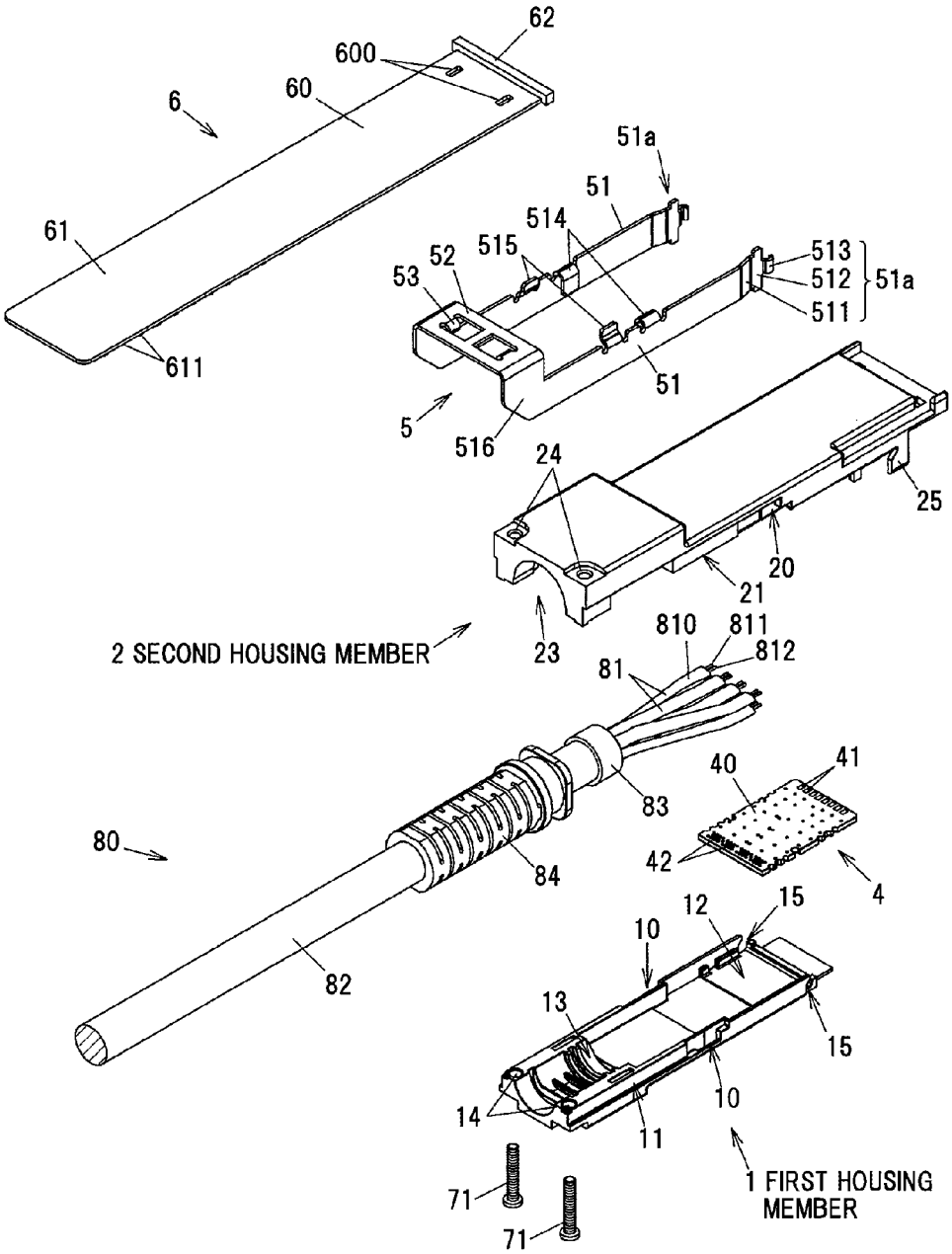
FIG. 2 is an exploded perspective view showing the connectorized cable.

FIG. 1 is a perspective view showing a connectorized cable and a connector in an embodiment of the invention. FIG. 2 is an exploded perspective view showing the connectorized cable. Although the upper side of FIG. 1 is sometimes described as "top" and the lower side of FIG. 1 as "bottom" in the following description for convenience of explanation, "top" and "bottom" are not limited to vertical top and bottom in the usage state of the connectorized cable.

A connectorized cable 7 has a connector 70 and a cable portion 80 of which one end is housed in the connector 70. The connector 70 is a standardized QSFP (Quad Small Form-factor Pluggable) connector. In the present embodiment, the connectorized cable 7 is a cable with electrical connector which transmits an electrical signal through the cable portion 80, and the connector 70 is an electrical connector having plural connection terminals 41.

The cable portion 80 has eight electric wires 81 as linear signal transmission media, a sheath 82 covering the eight electric wires 81 together, a copper ring 83 arranged at an end portion of the sheath 82, and a cylindrical rubber boot 84 fitted on the sheath 82. Each electric wire 81 is a differential signal line which is formed by covering a pair of signal lines 811 and 812 with a resin insulation 810 and transmits a differential signal through the pair of signal lines 811 and 812.

The connector 70 can be attached/detached to/from a cage 9 (see FIG. 6) as another member (described later) and is prevented, when fitted to the cage 9, from slipping off by locking pieces 91 and 92 provided on the cage 9.

The connector 70 is provided with a connector housing 3 composed of a first housing member 1 and a second housing member 2, a connecting member 4 supported on the connector housing 3, a sliding member 5 supported on the connector housing 3 so as to be slidable along a direction of attaching/detaching to/from the cage 9, and a pull-tub 6 as a pull member coupled to the sliding member 5.

The connector housing 3 is formed in a rectangular parallelepiped shape having its longitudinal direction along the direction of attaching/detaching to/from the cage 9, and is formed by coupling the first housing member 1 to the second housing member 2 using two bolts 71. The first housing member 1 and the second housing member 2 are formed by casting a zinc alloy.

Hereinafter, the longitudinal direction of the connector housing 3 is defined as X-direction, a direction of fitting the first housing member 1 to the second housing member 2 is defined as Y-direction, and a direction orthogonal to the X-direction as well as to the Y-direction is defined as Z-direction, as shown in FIG. 1. In addition, a moving direction for removing the connector housing 3 from the cage 9, which is one of the direction of attaching/detaching to/from the cage 9 along the X-direction, is referred to as "removal direction". On the cross section of the connector housing 3 orthogonal to the X-direction, the width in the Z-direction is greater than the width in the Y-direction.

Recessed portions 30 to be engaged with the locking pieces 91 and 92 of the cage 9 and guide grooves 31 for guiding the sliding member 5 in the longitudinal direction of the connector housing 3 are formed on the connector housing 3. Although the connector housing 3 has the recessed portions 30 and the guide grooves 31 on the both side surfaces in the Z-direction, FIG. 1 only shows the recessed portion 30 and the guide groove 31 on one of the side surfaces.

The connecting member 4 is formed by providing plural connection terminals 41 and plural electrodes 42 on a substrate 40 formed of an insulating material such as glass epoxy, and the substrate 40 is held by the connector housing 3. The plural connection terminals 41 are provided in a row at an edge of the connecting member 4 exposed from the connector housing 3. The plural electrodes 42 are provided at an edge of the connecting member 4 opposite to the edge with the plural connection terminals 41, and are connected to the pairs of signal lines 811 and 812 of the electric wires 81. The plural connection terminals 41 and the plural electrodes 42 are provided on both surfaces of the substrate 40. The plural connection terminals 41 are each formed of a metal foil provided on a surface of the substrate 40 and are connected to the electrodes 42 via a wiring pattern (not shown). The edge of the substrate 40 with the plural connection terminals 41 is configured as an edge connector.

Figure 3A:
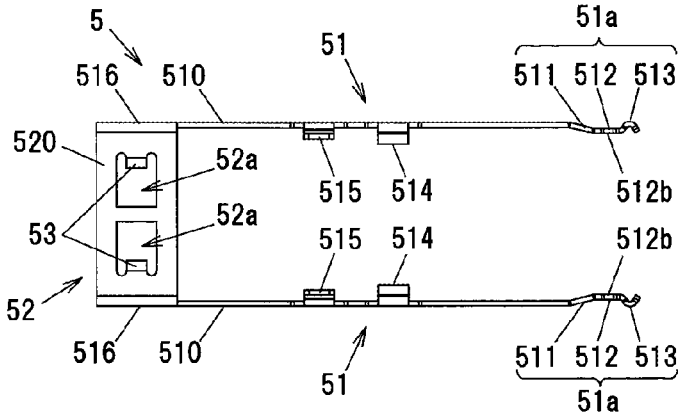
FIG. 3A is a top view showing a sliding member.
Figure 3B:
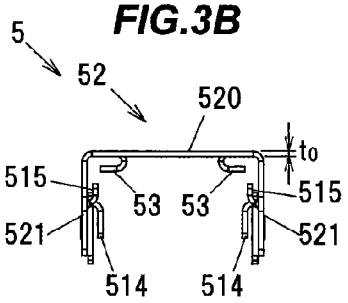
FIG. 3B is a side view showing the sliding member.
Figure 3C:
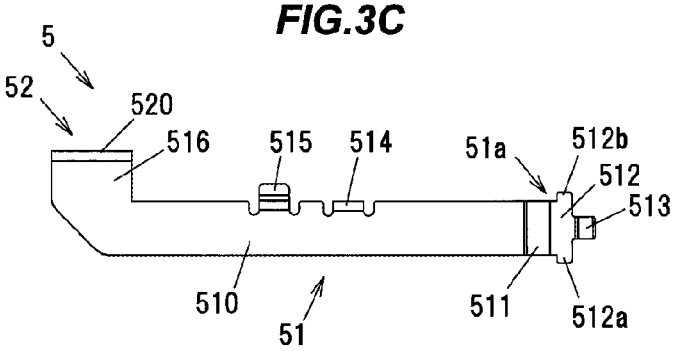
FIG. 3C is a front view showing the sliding member.
Figure 3D:
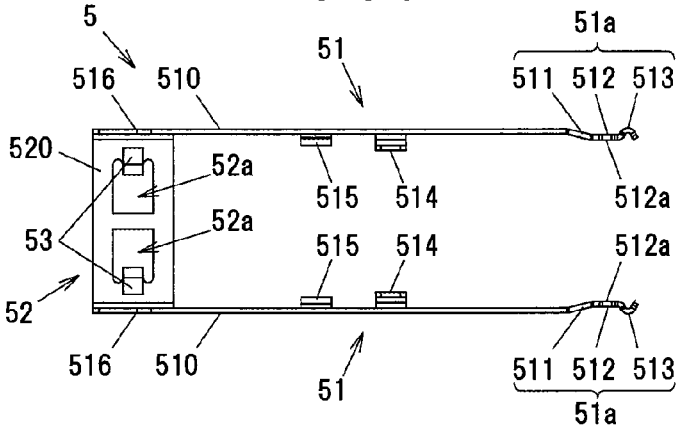
FIG. 3D is a bottom view showing the sliding member.

FIGS. 3A to 3D show the sliding member 5, wherein FIG. 3A is a top view thereof, FIG. 3B is a side view thereof, FIG. 3C is a front view thereof and FIG. 3D is a bottom view thereof.

The sliding member 5 integrally has a pair of arm portions 51 guided by the connector housing 3, a coupling portion 52 coupling the pair of arm portions 51, and a pair of protruding pieces 53 formed by cutting and lifting up a portion of the coupling portion 52. The sliding member 5 is formed by, e.g., punching out and bending a plate material formed of a metal such as stainless steel. The pair of arm portions 51 extend in the longitudinal direction of the connector housing 3 and are supported and guided by the guide grooves 31 of the connector housing 3. The coupling portion 52 couples end portions of the pair of arm portions 51.

Each arm portion 51 has a plate-shaped extending portion 510 which extends in the X-direction and is housed in the guide groove 31 of the connector housing 3. At an end portion of the arm portion 51 opposite to the coupling portion 52, a disengaging portion 51*a* for disengaging the locking piece 91 or 92 from the recessed portion 30 of the connector housing 3 is provided continuously from the extending portion 510.

The disengaging portion 51*a* is composed of an inclined portion 511 inclined relative to the extending portion 510, a flat-plate portion 512 which is parallel to the extending portion 510 and has a first protruding piece 512*a* and a second protruding piece 512*b* for restricting a movable range of the sliding member 5 in the X-direction, and a curved portion 513 curved into a semi-circular shape as viewed in the Y-direction. The flat-plate portion 512 is interposed between the inclined portion 511 and the curved portion 513. A distance in the Z-direction between the pair of arm portions 51 is smaller between the flat-plate portions 512 than between the extending portions 510. In addition, the width of the curved portion 513 in the Y-direction is smaller than the width of the extending portion 510 in the same direction. The first protruding piece 512*a* and the second protruding piece 512*b* of the flat-plate portion 512 protrude respectively beyond the top and bottom edges of the extending portions 510 in the Y-direction.

A first tongue piece 514 to be engaged with a first guide hole 16 (described later) formed on the first housing member 1 and a second tongue piece 515 to be engaged with a second guide hole 26 (described later) formed on the second housing member 2 are also formed on the arm portion 51. That is, the sliding member 5 slides in the X-direction in the state that the extending portions 510 are housed in the guide grooves 31, the first tongue pieces 514 are engaged with the first guide holes 16 of the first housing member 1 and the second tongue pieces 515 are engaged with the second guide holes 26 of the second housing member 2. Then the slide movement of the sliding member 5 in the removal direction relative to the connector housing 3 causes the locking pieces 91 and 92 to disengage from the recessed portions 30 of the connector housing 3. The details of this operation will be described later.

The coupling portion 52 has a rectangular plate shape of which long-side direction coincides with the Z-direction and the short-side direction coincides with the X-direction. Then, two openings 52*a* are formed on the coupling portion 52. The openings 52*a* are provided to form the protruding pieces 53 by cutting and lifting up, and penetrate the coupling portion 52 in the thickness direction thereof (the Y-direction). The coupling portion 52 couples shoulder portions 516 respectively formed on the pair of arm portions 51. The shoulder portion 516 is provided at an end portion of the arm portion 51 opposite to the disengaging portion 51*a* and protrudes from the extending portion 510 in the Y-direction.

Figure 4A:
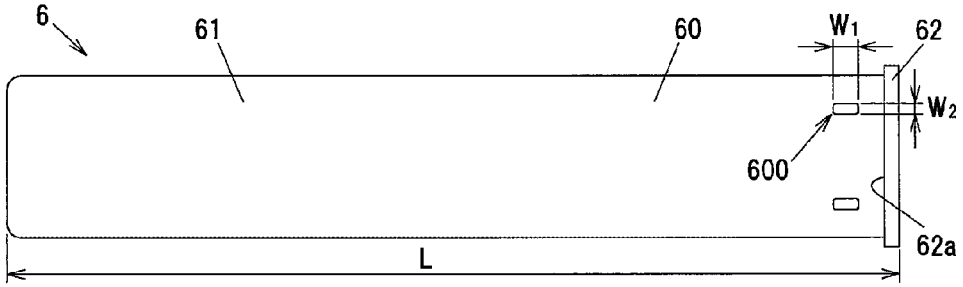
FIG. 4A is a top view showing a pull-tub.
Figure 4B:
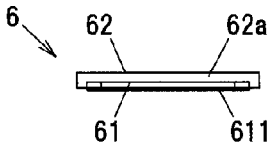
FIG. 4B is a side view showing the pull-tub.
Figure 4C:
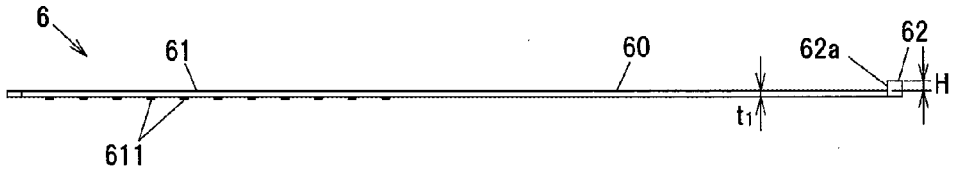
FIG. 4C is a front view showing the pull-tub.
Figure 4D:
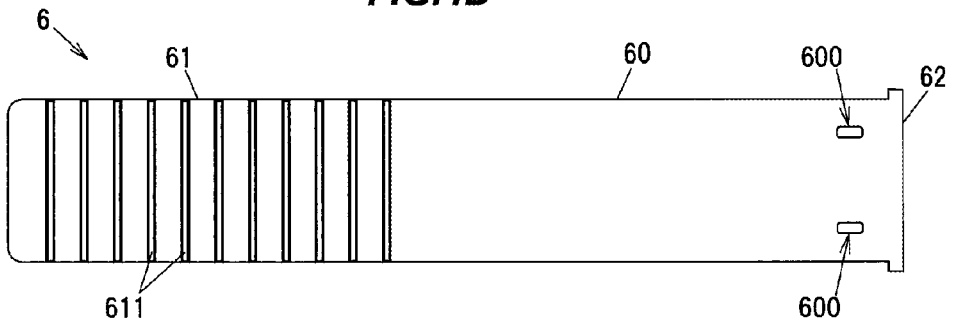
FIG. 4D is a bottom view showing the pull-tub.

FIGS. 4A to 4D show the pull-tub 6, wherein FIG. 4A is a top view thereof, FIG. 4B is a side view thereof, FIG. 4C is a front view thereof and FIG. 4D is a bottom view thereof.

The pull-tub 6 is a long plate-shaped member formed of, e.g., a nylon-based resin and has flexibility. In addition, the pull-tub 6 has its longitudinal direction parallel to the longitudinal direction of the connector housing 3 (the X-direction) and has an operating portion 61 which is provided at an end in the longitudinal direction and is to be operated when sliding and moving the sliding member 5 in the removal direction relative to the connector housing 3. On the back side (a surface facing the cable portion 80) of the operating portion 61 of the pull-tub 6, plural ribs 611 are provided so that a worker who carries out removal of the connector 70 from the cage 9 can surely hold the operating portion 61.

At an end portion of the pull-tub 6 in the longitudinal direction opposite to the operating portion 61, a protrusion 62 is formed so as to protrude in the thickness direction of the pull-tub 6 (the Y-direction) and to extend in the lateral direction (the Z-direction) orthogonal to the longitudinal direction of the pull-tub 6 (the removal direction). An extended portion 60 having the same width as the operating portion 61 is provided between the operating portion 61 and the protrusion 62.

Two through-holes 600 are formed at an end portion of the extended portion 60 on the protrusion 62 side. The two through-holes 600 are formed at a position on the operating portion 61 side with respect to the protrusion 62 in the longitudinal direction of the pull-tub 6 and are arranged side-by-side in the Z-direction. Each through-hole 600 is a long hole of which width in the longitudinal direction of the pull-tub 6 is greater than the width in the lateral direction. As shown in FIG. 4A, a width $W_1$ of the through-hole 600 in the longitudinal direction of the pull-tub 6 is, e.g., not less than 2.0 mm and not more than 3.0 mm and a width $W_2$ of the through-hole 600 in the lateral direction of the pull-tub 6 is, e.g., not less than 0.5 mm and not more than 2.0 mm. In addition, the entire length L of the pull-tub 6 in the longitudinal direction is, e.g., 93 mm.

The protruding pieces 53 of the sliding member 5 are respectively inserted into the through-holes 600. Each protruding piece 53 is formed by cutting and lifting up a portion of the coupling portion 52 in a direction orthogonal to the longitudinal and lateral directions of the pull-tub 6. In addition, in the present embodiment, the protruding piece 53 is curved into a U-shape as viewed from a side of the sliding member 5, as shown in FIG. 3B. Thus, the protruding piece 53 is prevented from slipping off from the through-hole 600, allowing the pull-tub 6 to be coupled to the sliding member 5.

A protruding height H of the protrusion 62 (see FIG. 4C) from the extended portion 60 in the thickness direction of the pull-tub 6 is greater than a thickness $t_0$ of the coupling portion 52 of the sliding member 5 (see FIG. 3B). The protruding height H of the protrusion 62 is, e.g., not less than 1.0 mm and not more than 2.5 mm, and the thickness $t_0$ of the coupling portion 52 is, e.g., not less than 0.3 mm and not more than 1.0 mm. In addition, a thickness $t_1$ of the extended portion 60 (see FIG. 4C) is, e.g., not less than 0.3 mm and not more than 1.0 mm. Then, a thickness of the operating portion 61 at a portion without the rib 611 is the same as the thickness $t_1$ of the extended portion 60.

The coupling portion 52 of the sliding member 5 faces a side surface 62*a* of the protrusion 62 of the pull-tub 6 which is a surface on the operating portion 61 side. Then the side surface 62*a* of the protrusion 62 butts against the coupling portion 52 of the sliding member 5 when the operating portion 61 of the pull-tub 6 is pulled in the removal direction, and a moving force in the removal direction is applied to the coupling portion 52 from the protrusion 62 and moves the sliding member 5.

Figure 5A:
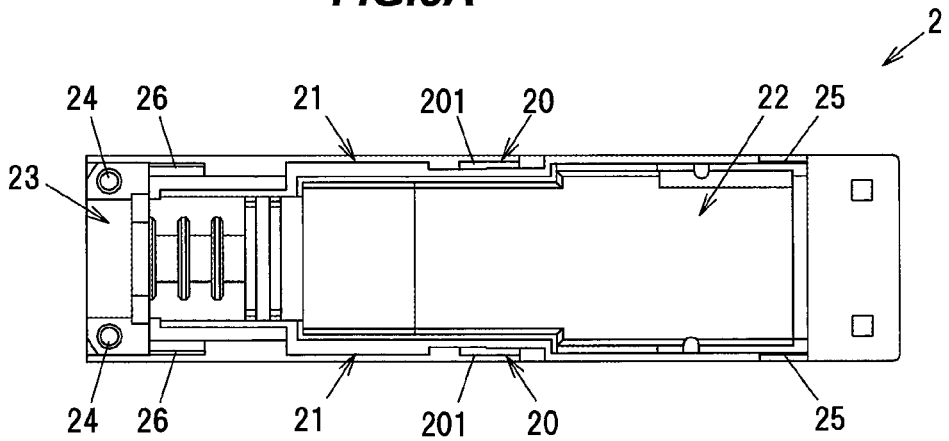
FIG. 5A is a bottom view showing a second housing member.
Figure 5B:
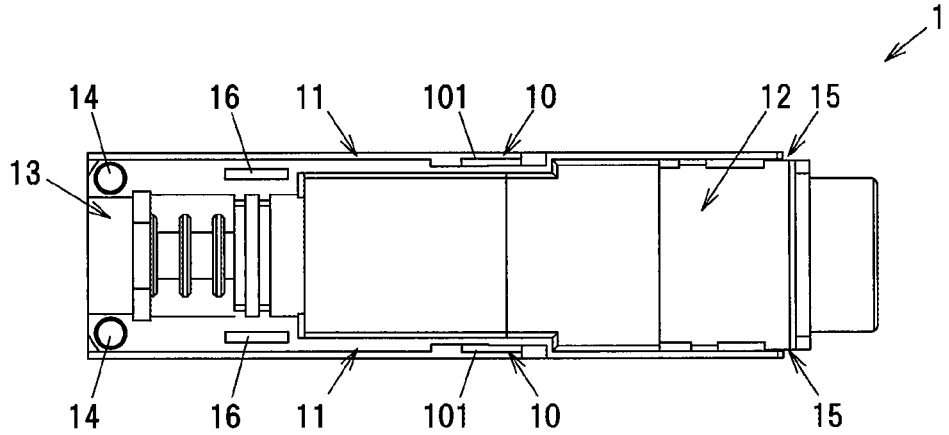
FIG. 5B is a top view showing a first housing member.

FIG. 5A is a bottom view showing the second housing member 2 and FIG. 5B is a top view showing the first housing member 1.

Each recessed portion 30 of the connector housing 3 is formed by combining a first recessed portion 10 of the first housing member 1 with a second recessed portion 20 of the second housing member 2. Meanwhile, each guide groove 31 of the connector housing 3 is formed by combining a first guide groove 11 of the first housing member 1 with a second guide groove 21 of the second housing member 2.

The substrate 40 of the connecting member 4 is held between a substrate holding portion 12 of the first housing member 1 and a substrate holding portion 22 of the second housing member 2, and the cable portion 80 is sandwiched between a cable holding portion 13 of the first housing member 1 and a cable holding portion 23 of the second housing member 2.

A pair of notches 15 (see FIG. 2) inclined relative to the longitudinal direction of the connector housing 3 are formed on the first housing member 1, while a pair of engaging protrusions 25 (see FIG. 2) respectively engaged with the pair of notches 15 are formed on the second housing member 2. In addition, two bolt insertion holes 14 for insertion of the two bolts 71 are formed on the first housing member 1, while two tapped holes 24 into which the two bolts are respectively threaded are formed on the second housing member 2. The engaging protrusions 25 are engaged with the notches 15, the bolts 71 inserted into the bolt insertion holes 14 are threaded into the tapped holes 24, and the first housing member 1 is thereby coupled to the second housing member 2.

Also, the first guide holes 16 to be engaged with the first tongue pieces 514 of the sliding member 5 are formed on the first housing member 1 so as to extend in the longitudinal direction of the connector housing 3. The second guide holes 26 to be engaged with the second tongue pieces 515 of the sliding member 5 are formed on the second housing member 2 so as to extend in the longitudinal direction of the connector housing 3.

In addition, recessed grooves 101 to be engaged with the first protruding pieces 512*a* of the flat-plate portions 512 of the disengaging portions 51*a* of the sliding member 5 are formed in the first recessed portions 10 of the first housing member 1, and recessed grooves 201 to be engaged with the second protruding pieces 512*b* of the flat-plate portions 512 of the disengaging portions 51*a* of the sliding member 5 are formed in the second recessed portions 20 of the second housing member 2. The length of the recessed grooves 101 and 201 in the X-direction is greater than the length of the first protruding piece 512*a* and the second protruding piece 512*b* in the same direction. The sliding member 5 is slidable relative to the connector housing 3 within a range in which the first protruding pieces 512*a* and the second protruding pieces 512*b* are movable in the recessed grooves 101 and 201.

Figure 6A:
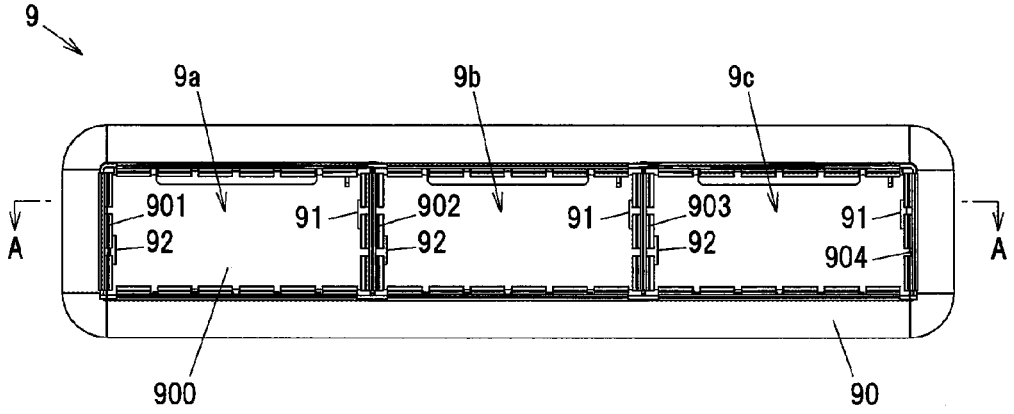
FIG. 6A is a front view showing a cage to which the connector is fitted.
Figure 6B:
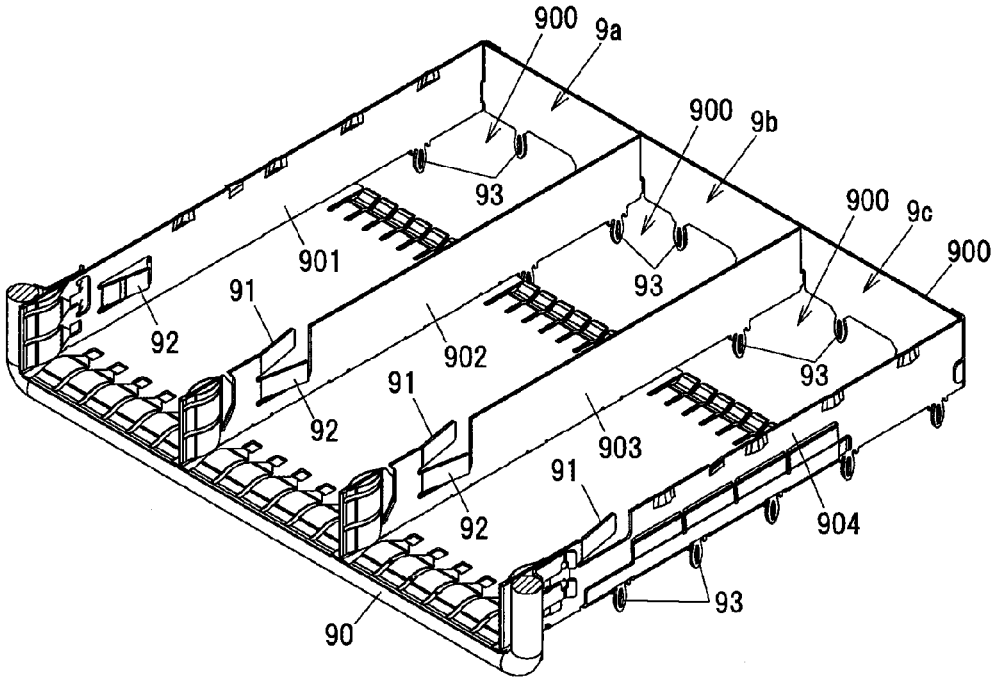
FIG. 6B is a perspective sectional view diagonally showing the cage taken along a line A-A in FIG. 6A.

FIG. 6A is a front view showing the cage 9 to which the connector 70 is fitted and FIG. 6B is a perspective sectional view diagonally showing the cage 9 taken on line A-A of FIG. 6A. The cage 9 is formed of a conductive metal and has an electromagnetic wave shielding function.

The cage 9 is a 3-port cage allowing three connectors 70 to be fitted, and has first to third fitting portions 9*a*, 9*b* and 9*c*. In the cage 9, each of the first to third fitting portions 9*a*, 9*b* and 9*c* has the locking pieces 91 and 92. The cage 9 is to be mounted on a printed circuit board (not shown) and has plural terminals 93 for electrically connecting and fixing to a ground conductor formed on the printed circuit board. In the following description, the locking piece 92 provided on the printed circuit board side is referred to as "lower locking piece 92", and the locking piece 91 located farther from the printed circuit board is referred to as "upper locking piece 91". That is, the cage 9 is provided with three upper locking pieces 91 and three lower locking pieces 92.

The cage 9 has first to fourth wall portions 901 to 904 which extend along the direction of attaching/detaching the connector 70. The first wall portion 901 has one upper locking piece 91 formed by cutting and lifting up a portion thereof. Meanwhile, each of the second and third wall portions 902 and 903 has one upper locking piece 91 and one lower locking piece 92 which are formed by cutting and lifting up a portion thereof. Then, the fourth wall portion 904 has one lower locking piece 92 formed by cutting and lifting up a portion thereof. The second wall portion 902 separates the first fitting portion 9*a* from the second fitting portion 9*b*, and the third wall portion 903 separates the second fitting portion 9*b* from the third fitting portion 9*c*.

A rectangular frame 90 is provided on the front side of the cage 9, and the connectors 70 are inserted into the first to third fitting portions 9*a*, 9*b* and 9*c* from the frame 90 side. Each of the first to third fitting portions 9*a*, 9*b* and 9*c* has an opening 900 on the back side (the opposite side to the frame 90) so that other connectors (not shown) provided on the printed circuit board can be inserted into the first to third fitting portions 9*a*, 9*b* and 9*c*. The connecting member 4 of the connector 70 is connected to one of the other connectors.

Next, an operation to disengage the upper locking piece 91 and the lower locking piece 92 from the recessed portions 30 of the connector housing 3 will be described in reference to FIGS. 7A to 8B.

Figure 7A:
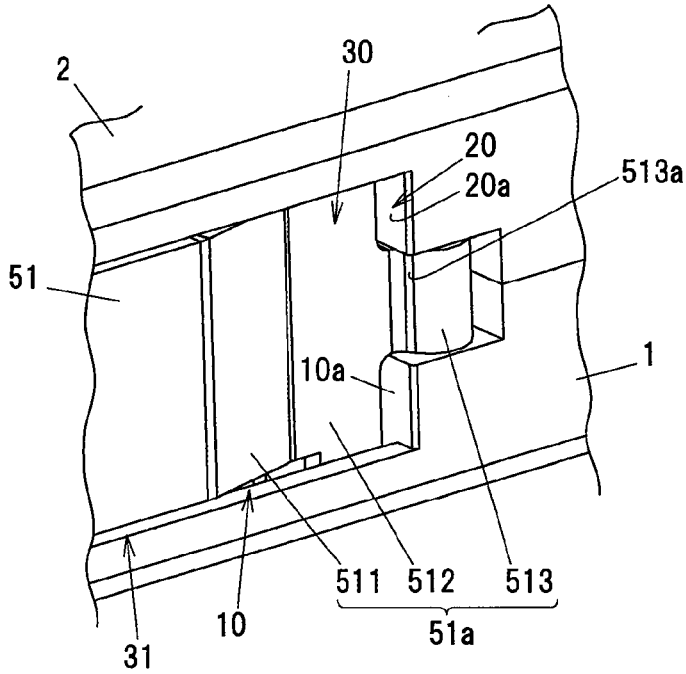
Figure 7B:
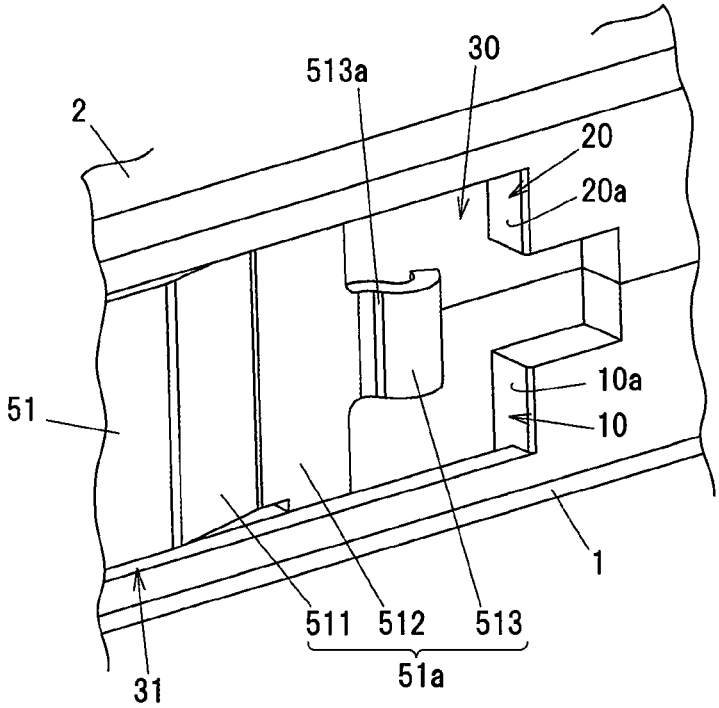
Figure 8A:
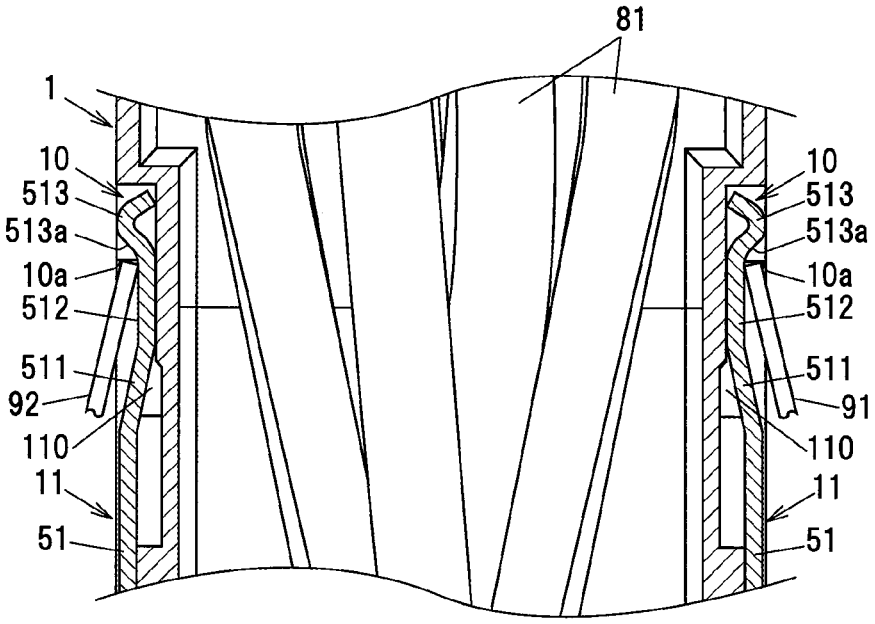
FIG. 8A is an illustration diagram showing a situation where an upper locking piece and a lower locking piece are engaged with the recessed portions of the connector housing.
Figure 8B:
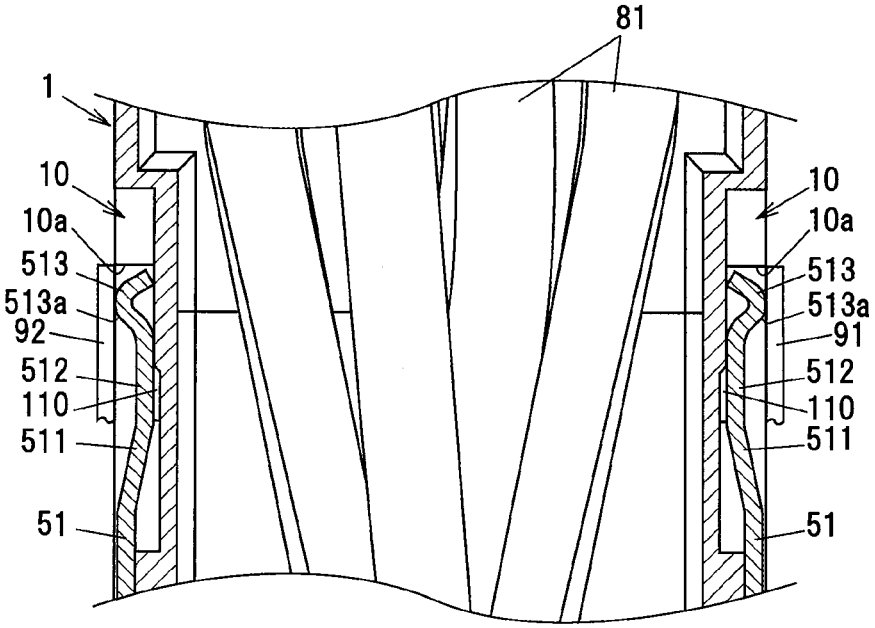
FIG. 8B is an illustration diagram showing a situation where the upper locking piece and the lower locking piece are disengaged from the recessed portions of the connector housing.

FIGS. 7A and 7B are perspective views showing the disengaging portion 51*a* of the sliding member 5 in the recessed portion 30 of the connector housing 3, wherein FIG. 7A shows a situation where the sliding member 5 is located on the connector housing 3 at a movable limit in a direction opposite to the removal direction and FIG. 7B shows a situation where the sliding member 5 is located on the connector housing 3 at a movable limit in the removal direction. FIG. 8A shows a situation where the upper locking piece 91 and the lower locking piece 92 are engaged with the recessed portions 30 of the connector housing 3 and FIG. 8B shows a situation where the upper locking piece 91 and the lower locking piece 92 are disengaged from the recessed portions 30 of the connector housing 3. FIGS. 8A and 8B show the sliding member 5 and the first housing member 1 on the cross section taken parallel to the X-direction and to the Y-direction.

When the connector 70 is fitted to one of the first to third fitting portions 9*a*, 9*b* and 9*c* of the cage 9, the upper locking piece 91 and the lower locking piece 92 are respectively engaged with the pair of recessed portions 30 of the connector housing 3, as shown in FIG. 8A. When a force in the removal direction is applied to the connector housing 3 in this state, a tip portion of the lower locking piece 92 butts against a contact surface 10*a* of the first recessed portion 10 of the first housing member 1 and a tip portion of the upper locking piece 91 butts against a contact surface 20*a* of the second recessed portion 20 of the second housing member 2. This prevents the connector housing 3 from slipping off.

Meanwhile, when removing the connector 70 from the cage 9, a worker holds the operating portion 61 of the pull-tub 6 and pulls the pull-tub 6. Then, the sliding member 5 coupled to the pull-tub 6 slides relative to the connector housing 3 along the longitudinal direction. Due to the slide movement, the upper locking piece 91 and the lower locking piece 92 come into contact with outer surfaces 513*a* of the curved portions 513 of the disengaging portions 51*a* and receive a force in a direction to come out from the recessed portions 30 and, as shown in FIG. 8B, the upper locking piece 91 and the lower locking piece 92 are disengaged from the recessed portions 30 of the connector housing 3. Then, when the pull-tub 6 is pulled further, the connector housing 3 receives a force in the removal direction from the first protruding pieces 512*a* and the second protruding pieces 512*b* of the flat-plate portions 512 of the sliding member 5 and is removed from the cage 9.

As described above, when removing the connector 70 from the cage 9, pull operation of the operating portion 61 of the pull-tub 6 by the worker disengages the upper locking piece 91 and the lower locking piece 92 to cancel slip-off prevention of the connector housing 3, and the connector housing 3 is removed from the cage 9 by further pulling the operating portion 61. The force of pulling the operating portion 61 of the pull-tub 6 is transferred to the sliding member 5 when the protrusion 62 of the pull-tub 6 butts against the coupling portion 52 of the sliding member 5, as described above. Therefore, the pull-tub 6 is required to have durability so as not to crack or to be broken even when the connector 70 is repeatedly attached/detached to/from the cage 9.

Figure 9:
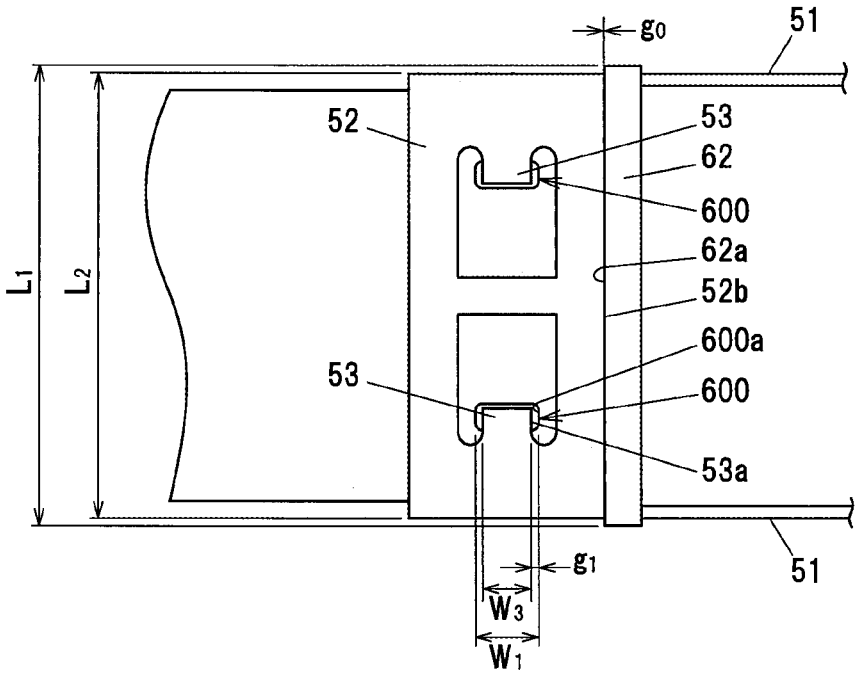
FIG. 9 is a plan view showing a protrusion of the pull-tub and a coupling portion of the sliding member.

FIG. 9 is a plan view showing the protrusion 62 of the pull-tub 6 and the coupling portion 52 of the sliding member 5. FIG. 9 shows a state in which the side surface 62*a* of the protrusion 62 butts against an end face 52*b*, in the X-direction, of the coupling portion 52.

The protrusion 62 of the pull-tub 6 is formed so that both ends in the lateral direction of the pull-tub 6 (the Z-direction) protrude from the extended portion 60. In addition, a length $L_1$ of the protrusion 62 in the lateral direction of the pull-tub 6 is not less than a length $L_2$ of the coupling portion 52 of the sliding member 5 in the same direction. Thus, the coupling portion 52 butts against the side surface 62*a* of the protrusion 62 entirely across the lateral direction of the pull-tub 6.

Since the width $W_1$ of the through-hole 600 in the longitudinal direction of the pull-tub 6 is greater than a width $W_3$ of the protruding piece 53 in the same direction, the protruding piece 53 of the sliding member 5 does not come into contact with an inner surface 600*a* of the through-hole 600 when the coupling portion 52 of the sliding member 5 butts against the side surface 62*a* of the protrusion 62 of the pull-tub 6.

In more detail, as shown in FIG. 9, when the protrusion 62 butts against the coupling portion 52 in the longitudinal direction of the pull-tub 6 and a dimension $g_0$ of a gap between the side surface 62*a* of the protrusion 62 and the end face 52*b* of the coupling portion 52, as a surface in the X-direction and facing the protrusion 62, is zero, there is a gap having a dimension $g_1$ (>0) between an end face 53*a* of the protruding piece 53 on the protrusion 62 side and the inner surface 600*a* of the through-hole 600. FIG. 9 only shows a dimension of one of the through-holes 600 and that of one of the protruding pieces 53 since two through-holes 600 of the pull-tub 6 are symmetric and have the same size and also two protruding pieces 53 of the sliding member 5 are symmetric and have the same size.

Functions and Effects of the First Embodiment

The following functions and effects are obtained in the embodiment.

(1) When the connector 70 fitted to the cage 9 is removed from the cage 9, pull operation of the operating portion 61 of the pull-tub 6 in the removal direction causes the side surface 62*a* of the protrusion 62 of the pull-tub 6 as a surface on the operating portion 61 side to butt against the coupling portion 52 of the sliding member 5. Then, a moving force in the removal direction is applied to the coupling portion 52 from the protrusions 62 of the pull-tub 6 and moves the sliding member 5. Thus, a contact region between the pull-tub 6 and the sliding member 5 is large, the force of pulling the pull-tub 6 is uniformly dispersed within the contact region and is transferred from the pull-tub 6 to the sliding member 5, and it is thereby possible to prevent the pull-tub 6 from cracking or being broken. As a result, it is possible to increase durability of the connector 70 and the connectorized cable 7.

(2) The protruding pieces 53 of the sliding member 5 inserted through the through-holes 600 of the pull-tub 6 allow the pull-tub 6 to be held along the longitudinal direction of the connector housing 3. Thus, workability when removing the connector 70 from the cage 9 is improved.

(3) Since the through-hole 600 is a long hole of which width in the longitudinal direction of the pull-tub 6 is greater than the width in the lateral direction, a decrease in pulling strength in the longitudinal direction of the pull-tub 6 caused by providing the through-holes 600 can be suppressed. In addition, the protruding piece 53 is formed by cutting and lifting up a portion of the coupling portion 52 in a direction orthogonal to the longitudinal and lateral directions of the pull-tub 6. Therefore, it is easy to form the protruding piece 53 without increasing the size of the sliding member 5.

(4) When the side surface 62*a* of the protrusion 62 of the pull-tub 6 butts against the end face 52*b* of the coupling portion 52 of the sliding member 5, the end face 53*a* of each protruding piece 53 of the sliding member 5 in the longitudinal direction of the pull-tub 6 does not come into contact with the inner surface 600*a* of the through-hole 600. This prevents the force of pulling the pull-tub 6 from being transferred between the end faces 53*a* of the protruding pieces 53 and the inner surfaces 600*a* of the through-holes 600, and the pull-tub 6 can be prevented from cracking or being broken. In other words, if the force of pulling the pull-tub 6 is transferred from the pull-tub 6 to the sliding member 5 via the protruding pieces 53, the contact region therebetween is very small and the pull-tub 6 is likely to crack or to be broken. On the other hand, such damaged can be prevented in the present embodiment since the force of pulling the pull-tub 6 is transferred between the protrusion 62 of the pull-tub 6 and the coupling portion 52 of the sliding member 5. In addition, even when a burr is formed on the protruding piece 53, damage on the pull-tub 6 due to the burr can be prevented.

(5) The length $L_1$ of the protrusion 62 in the lateral direction of the pull-tub 6 is not less than the length $L_2$ of the coupling portion 52 of the sliding member 5 in the same direction. This allows the coupling portion 52 to butt against the side surface 62*a* of the protrusion 62 entirely across the lateral direction of the pull-tub 6. As a result, an effect of dispersing the force of pulling the pull-tub 6 is sufficiently exerted and the pull-tub 6 can be more reliably prevented from cracking or being broken.

Summary of the Embodiment

Technical ideas understood from the embodiment will be described below citing the reference numerals, etc., used for the embodiment. However, each reference numeral described below is not intended to limit the constituent elements in the claims to the members, etc., specifically described in the embodiment.

[1] A connector (70) to be fitted to another member (cage 9) and to be prevented from slipping off by locking pieces (91, 92) provided on the other member (9), the connector (70) comprising: a connector housing (3) comprising recessed portions (30) to be engaged with the locking pieces (91, 92); a metal sliding member (5) that is supported on the connector housing (3) so as to be slidable along a direction of attaching/detaching to/from the other member (9) and disengages the locking pieces (91, 92) from the recessed portions (30) by moving in a direction of removal from the other member (9); and a long plate-shaped resin pull member (pull-tub 6) that is coupled to the sliding member (5) and comprises an operating portion (61) to be operated when moving the sliding member (5) in the direction of removal; wherein a protrusion (62) is formed on the pull member (6) so as to protrude in a thickness direction thereof and to extend in a lateral direction orthogonal to a longitudinal direction along the direction of removal, the sliding member (5) comprises a pair of arm portions (51) guided by the connector housing (3) and a coupling portion (52) coupling the pair of arm portions (51) and facing a side surface (62*a*) of the protrusion (62) of the pull member (6) that is a surface on the operating portion (61) side, and the side surface (62*a*) of the protrusion (62) butts against the coupling portion (52) when the operating portion (61) of the pull member (6) is pulled in the direction of removal, and a moving force in the direction of removal is applied to the coupling portion (52) from the protrusion (62) and moves the sliding member (5).

[2] The connector (70) described in the [1], wherein the pull member (6) comprises through-holes (600) formed at a position on the operating portion (61) side in the longitudinal direction with respect to the protrusion (62), and the sliding member (5) comprises protruding pieces (53) to be inserted into the through-holes (600).

[3] The connector (70) described in the [2], wherein the through-hole (600) is a long hole with a width ($W_1$) in the longitudinal direction greater than a width ($W_2$) in the lateral direction, and the protruding piece (53) is formed by cutting and lifting up a portion of the coupling portion (52) in a direction orthogonal to the longitudinal and lateral directions.

[4] The connector (70) described in the [2] or [3], wherein an end face (53*a*) of the protruding piece (53) in the longitudinal direction does not come into contact with an inner surface (600*a*) of the through-hole (600) when the side surface (62*a*) of the protrusion (62) of the pull member (6) butts against the coupling portion (52) of the sliding member (5).

[5] The connector (70) described in any of the [1] to [4], wherein a length of the protrusion (62) in the lateral direction is greater than a length of the coupling portion (52) in the same direction, and the coupling portion (52) butts against the side surface (62*a*) of the protrusion (62) entirely across the lateral direction.

A connectorized cable (7), comprising: the connector (70) described in any of the [1] to [5]; and a cable portion (80) having one end housed in the connector (70) and comprising linear signal transmission media (electric wires 81).

Although the embodiment of the invention has been described, the invention according to claims is not to be limited to the embodiment. Further, please note that all combinations of the features described in the embodiment are not necessary to solve the problem of the invention.

In addition, the invention can be appropriately modified and implemented. For example, although the signal transmission media of the cable portion 80 are the electric wires 81 in the embodiment, it is not limited thereto. The signal transmission media of the cable portion 80 may be optical fibers. In this case, the connector 70 has an optical adapter in place of the connecting member 4. Alternatively, the signal transmission media of the cable portion 80 may be a combination of the electric wires 81 and optical fibers.

What is claimed is:

1. A connector for being fitted to an other member so as to be prevented from slipping off by a locking piece provided on the other member, the connector comprising:

a connector housing comprising a recessed portion to be engaged with the locking piece;

a metal sliding member that is supported on the connector housing so as to be slidable along a direction of attaching/detaching to/from the other member and disengages the locking piece from the recessed portion by moving in a direction of removal from the other member; and a long plate-shaped resin pull member that is coupled to the sliding member and comprises an operating portion to be operated when moving the sliding member in the direction of removal;

wherein a protrusion is formed on the pull member so as to protrude in a thickness direction thereof and to extend in a lateral direction orthogonal to a longitudinal direction along the direction of removal, wherein the sliding member comprises a pair of arm portions guided by the connector housing and a coupling portion coupling the pair of arm portions and facing a side surface of the protrusion of the pull member that is a surface on the operating portion side, and wherein the side surface of the protrusion butts against the coupling portion when the operating portion of the pull member is pulled in the direction of removal such that a moving force in the direction of removal is applied to the coupling portion from the protrusion so as to move the sliding member.

2. The connector according to claim 1, wherein the pull member comprises a through-hole formed at a position on the operating portion side in the longitudinal direction with respect to the protrusion, and wherein the sliding member comprises a protruding piece to be inserted into the through-hole.

3. The connector according to claim 2, wherein the through-hole is a long hole with a width in the longitudinal direction greater than a width in the lateral direction, and wherein the protruding piece is formed by cutting and lifting up a portion of the coupling portion in a direction orthogonal to the longitudinal and lateral directions.

4. The connector according to claim 2, wherein an end face of the protruding piece in the longitudinal direction does not come into contact with an inner surface of the through-hole when the side surface of the protrusion of the pull member butts against the coupling portion of the sliding member.

5. The connector according to claim 1, wherein a length of the protrusion in the lateral direction is greater than a length of the coupling portion in the same direction, and wherein the coupling portion butts against the side surface of the protrusion entirely across the lateral direction.

6. A connectorized cable, comprising:

the connector according to claim 1; and a cable portion having one end housed in the connector and comprising linear signal transmission media.

* * * * *